US007335857B2

(12) United States Patent
Eller

(10) Patent No.: US 7,335,857 B2
(45) Date of Patent: Feb. 26, 2008

(54) GLOW PLUG INCLUDING A ROD-SHAPED HEATING ELEMENT ATTACHED IN A TUBULAR CARRIER ELEMENT BY HAVING BEEN MAGNETICALLY DEFORMED

(75) Inventor: Martin Eller, Ludwigsburg (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/805,272

(22) Filed: Mar. 22, 2004

(65) Prior Publication Data

US 2004/0173596 A1 Sep. 9, 2004

Related U.S. Application Data

(62) Division of application No. 10/207,384, filed on Jul. 30, 2002, now Pat. No. 6,734,400.

(30) Foreign Application Priority Data

Jul. 30, 2001 (DE) ..... 101 36 596

(51) Int. Cl.
*F23Q 7/22* (2006.01)

(52) U.S. Cl. ..... 219/270; 219/672; 219/523; 219/553; 123/145 A; 29/611

(58) Field of Classification Search ..... 219/270, 219/267, 672; 123/145 A; 29/610.1, 611, 29/613, 614, 419.2, 829; 72/56
See application file for complete search history.

(56) References Cited

U.S. PATENT DOCUMENTS 3,345,732 A * 10/1967 Brower ..... 29/419.2
3,412,590 A * 11/1968 Lippmann et al ..... 72/56
3,599,462 A 8/1971 Kline et al.
3,618,350 A 11/1971 Larrimer, Jr.
4,205,422 A 6/1980 Hardwick
4,207,451 A 6/1980 Tudbury
4,475,030 A 10/1984 Bailey
5,442,846 A 8/1995 Snaper (Continued)

FOREIGN PATENT DOCUMENTS

DE 198 15 244 A1 10/1999

(Continued)

OTHER PUBLICATIONS

MAGNETOPLUS®, Magnet-Physik Dr. Steingroever GMBH, Köln, 1997, 1846/97, 4 Pages.

(Continued)

*Primary Examiner*—Tu Ba Hoang
*Assistant Examiner*—Leonid Fastovsky
(74) *Attorney, Agent, or Firm*—David S. Safran

(57) ABSTRACT

A rod-shaped heating element with a tubular carrier element attached to a cylindrical carrier ring and to the rod-shaped heating element using a magnetic forming process, the carrier ring and the rod-shaped heating element being within the tubular carrier element with the outer circumferential surface of the carrier ring contacting the inner circumferential surface of the tubular carrier element. As a result of the parts having been joined by magnetic forming, they are in a plastically deformed state which is free of thermal treatment effects and scuffing.

1 Claim, 2 Drawing Sheets

U.S. PATENT DOCUMENTS

| | | | |
|---|---|---|---|
| 5,813,264 | A | 9/1998 | Steingroever |
| 6,054,680 | A | 4/2000 | Locher et al. |
| 6,229,125 | B1 | 5/2001 | Livshiz et al. |
| 6,255,626 | B1 | 7/2001 | Endler et al. |
| 6,335,516 | B1 | 1/2002 | Muller et al. |
| 6,474,534 | B2 | 11/2002 | Gabbianelli et al. |
| 6,477,774 | B1 | 11/2002 | Marando et al. |
| 6,605,801 | B2 | 8/2003 | Haussner et al. |
| 2001/0047989 | A1 | 12/2001 | Watqanabe et al. |

FOREIGN PATENT DOCUMENTS

| | | |
|---|---|---|
| EP | 0 843 130 A1 | 5/1998 |
| JP | 10 141326 | 5/1998 |

OTHER PUBLICATIONS

Magnetic Forming of Pressure Tight Joints, Metalworking Production, May 6, 1964.

* cited by examiner

GLOW PLUG INCLUDING A ROD-SHAPED HEATING ELEMENT ATTACHED IN A TUBULAR CARRIER ELEMENT BY HAVING BEEN MAGNETICALLY DEFORMED

BACKGROUND OF THE INVENTION

1. Field of the Invention

The invention relates to a method for joining a rod-shaped heating element with a tubular carrier element, and a rod glow plug which includes a rod-shaped heating element in a tubular glow plug body.

2. Description of Related Art

Rod-shaped heating elements which are supported in tubular carrier elements are known. One of the best known examples of a rod-shaped heating element is a glow plug which includes a rod-shaped glow pencil is supported in a tubular glow plug body.

When joining a glow pencil and a glow plug body, the glow pencil is pressed or inserted into the glow plug body. In such a case, only materials which exhibit sufficient deformability and non-deformability for such a pressing-in operation can be used. For pressing-in the heating element, certain component lengths, especially of the glow pencil, should not be exceeded in order to avoid buckling of this component during the pressing-in operation. Furthermore, grooves can arise during pressing-in, which lead to looseness between the glow pencil and the glow plug body.

SUMMARY OF THE INVENTION

The object of the present invention is to provide a method of joining a rod-shaped heating element with a tubular carrier element so as to overcome the aforementioned disadvantageous effects that occur with the pressing-in of the heating element into the carrier element. At the same time, the method in accordance with the present invention does not require a certain component length in order to avoid the buckling of the component. In this regard, a ceramic rod-shaped heating element may be used in order to be easily joined with metal carrier elements without the aforementioned groove formation occurring.

The aforementioned problems are solved in accordance with the present invention by providing a method of joining a rod-shaped heating element with a tubular carrier element whereby a cylindrical carrier ring is connected to the rod-shaped heating element using magnetic forming technology, and the rod-shaped heating element and carrier element are subsequently inserted into the tubular carrier element.

An advantageous feature in accordance with the present invention is the attaching or forming of the rod-shaped heating element with a carrier ring using magnetic forming technology. The magnetic forming technology used may be MagnetoPuls® from Magnet-Physik Dr. Steingroever GmbH of Cologne, Germany. As described in the 1997 MagnetoPuls® brochure 1846/97, magnetic forming technology is a non-contact joining process that requires no pretreatment or post-treatment, produces no surface damage, forms a finished product which has not been subjected to the effects of soldering or welding since the parts are cold during magnetic forming.

The present invention will be explained in greater detail with a preferred example of a glow plug with rod-shaped heating element and tubular carrier element according to the following figures, which show:

DETAILED DESCRIPTION OF THE INVENTION

Figure 1:
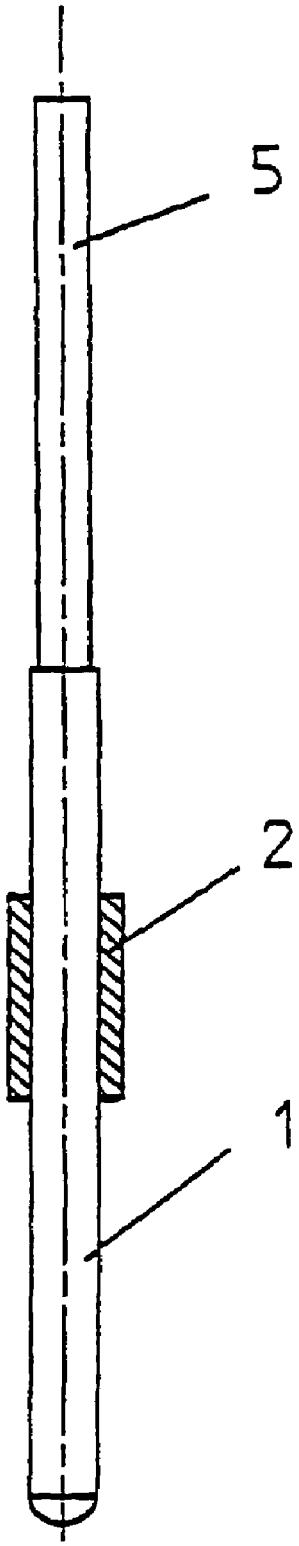
FIG. 1 shows a diagrammatic side view of a glow pencil with a cylindrical carrier ring and a connection pole.

FIG. 1 shows a diagrammatic side view of a glow pencil 1 made of an electrically conductive ceramic, on which a carrier ring 2 is formed or attached using magnetic forming technology. The material of carrier ring 2 is electrically conductive and deformable using magnetic forming technology. A connection pole 5 used as a positive pole is connected to the glow pencil 1.

Figure 2:
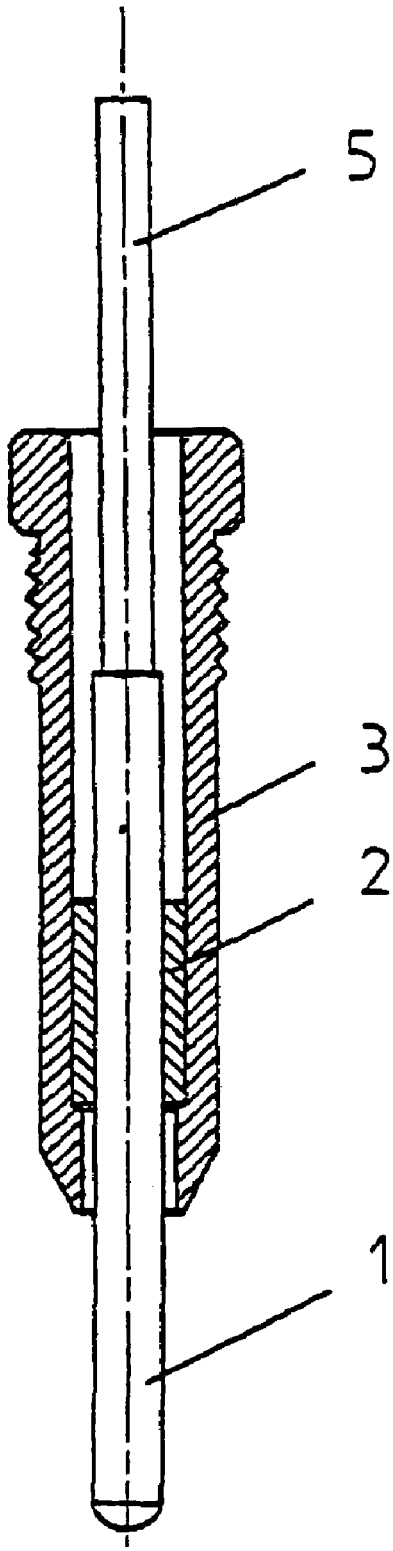
FIG. 2 shows a glow pencil provided with a carrier ring and a connection pole, each of which is fitted into a glow plug casing.

As shown in FIG. 2, a single-pole glow plug as shown FIG. 1 is inserted into the glow plug body 3, the glow plug body serving as an earth or negative pole. The insertion of the glow pencil and the carrier ring 2 is such that the pressing-in or inserting force is brought to bear on the carrier ring 2, so that the risk of buckling the glow pencil 1 and the connection pole 5 is prevented. Such a design permits the use of very thin glow pencils 1 and glow pencils that are composed of a brittle material, such as ceramics. Preferably, the glow plug body 3 is attached to the carrier ring 2 using magnetic forming technology, as will be described in detail somewhat later in the description of FIGS. 4 and 5.

Alternatively, instead of composing the glow pencil 1 of a ceramic material, the glow pencil 3 may be composed of an electrically conductive metal. The method in accordance with the present invention is advantageous since the electrically conductive metal glow pencil 1 does not have to have the thickness and stability of conventional glow pencils, and thus, permits the production and joining, connecting or attaching of very thin-walled glow pencils 1 and glow-pencil casings or bodies 3.

Figure 3:
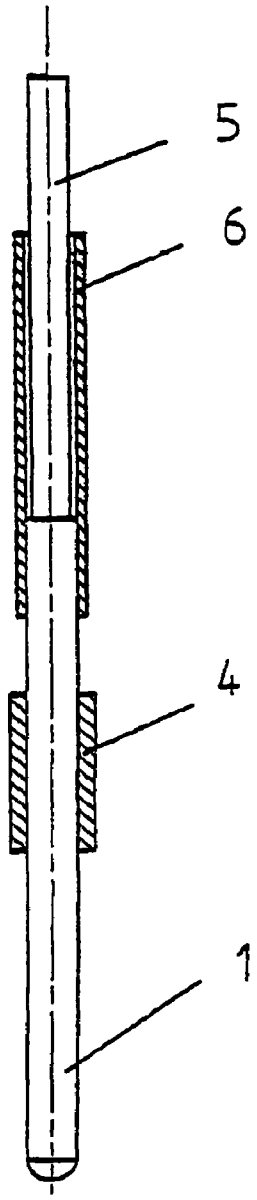
FIG. 3 shows a glow pencil with a cylindrical carrier ring, a contact sleeve and a connection pole.

FIG. 3 shows, in a second embodiment of the invention, a glow plug including a glow pencil 1, a carrier ring 4 and a connection pole 5. The glow pencil 1, preferably composed of a ceramic, is connected to an internal pole 5 which axially projects on a connection side. Also provided on the connection side so as to axially surround the glow pencil 1 and the connection pole 5 is a contact sleeve 6 that is connected thereto using magnetic forming technology. The carrier ring 4 is preferably composed of a material that is deformable when using magnetic forming technology. However, the surface of the carrier ring 4, at least the outer circumferential surface, may be made to become electrically insulating by coating it with an electrically insulating ceramic layer. Furthermore, the carrier ring 4 is attached or connected to the glow pencil 1 using magnetic forming technology.

Alternatively, the glow pencil 1 can also be composed of steel, whereby it is then electrically insulated by depositing a ceramic layer thereon.

If the contact sleeve 6 has an identical external diameter to the carrier ring 4, outer circumferential surface is designed so as to be insulated by providing an electrically insulating ceramic coating. Preferably, however, the external diameter of the carrier ring 4 is greater than the external diameter of the contact sleeve 6 so that the glow plug body 3 does not physically contact the contact sleeve 6. The carrier ring 4 is preferably composed of copper or an aluminum alloy, and may be insulated with an anodized layer or a lacquer layer.

Figure 4:
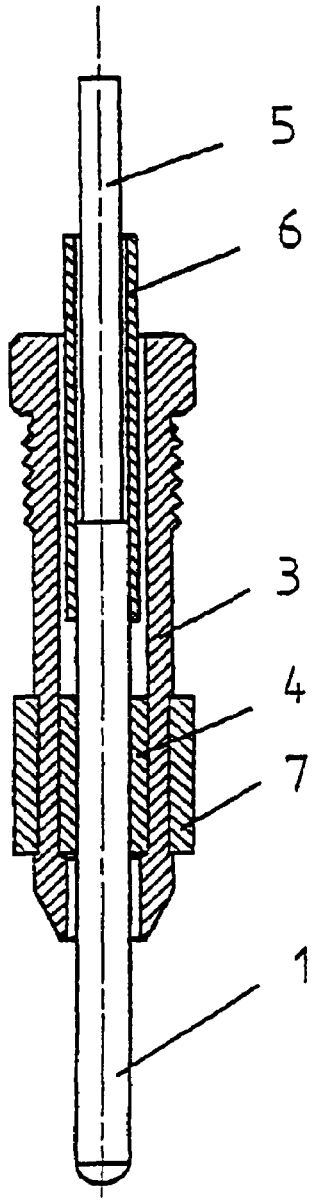
FIG. 4 shows the glow pencil shown in FIG. 3 with a carrier ring, a contact sleeve and a connection pole in a glow plug body with a transfer ring lying adjacent on the outside.

As shown in FIG. 4, the glow plug in accordance with FIG. 3 is inserted into the glow plug body 3 using magnetic forming technology. Surrounding the glow plug body 3 and the carrier ring 4 is a transfer ring 7, through which the magnetic forming of the components occurs.

Figure 5:
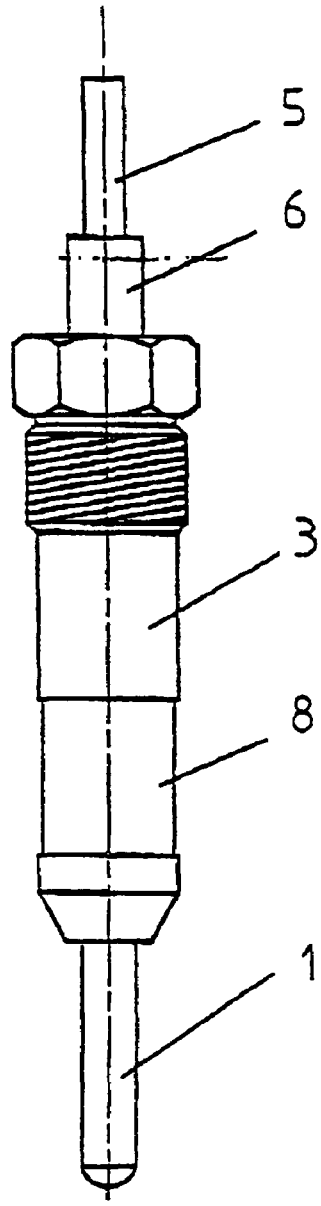
FIG. 5 shows another embodiment of a glow plug in accordance with FIGS. 3 and 4 with the transfer ring removed and a sealing and fixing cylindrical necked-down portion of a glow plug body.

As shown in FIG. 5, the glow plug body 3, after removal of transfer ring 7, has a cylindrical necked-down portion 8 which is formed over the internal carrier ring 4, thereby firmly joining the arrangement shown in FIG. 3 in the glow plug body 3. The contact sleeve 6, which projects from the glow plug body 3, is designed as a negative-contact connection while the glow plug casing 3 is potential-free. Preferably, the contact sleeve 6, the carrier rings 2, 4 and the transfer ring 7 are respectively composed of copper, aluminum or light-metal alloys.

What is claimed is:

1. A glow plug comprising:

a rod-shaped heating element, said rod-shaped heating element being composed of an electrically conductive ceramic material;

a cylindrical carrier ring for attachment to said rod-shaped heating element, said cylindrical carrier ring being composed of a magnetically-deformable material and having an outer circumferential surface thereof being electrically insulated;

a contact sleeve for attachment to said rod-shaped heating element in an area adjacent to a connection side thereof so as to axially extend therefrom, said contact sleeve being composed of an electrically conductive material;

a tubular casing for surrounding said rod-shaped heating element, said cylindrical carrier ring and said contact sleeve, said tubular casing having been attached to said cylindrical carrier ring by a magnetic forming process so as not to physically contact said contact sleeve, and as a result of which the carrier ring and tubular casing are in a plastically deformed state which is free of surface damage and thermal effects of being heated during attachment, wherein said contact sleeve and cylindrical carrier ring have been attached to said rod-shaped heating element by a magnetic forming process as a result of which the carrier ring and contact sleeve are in a plastically deformed state which is free of surface damage and thermal effects of being heated during attachment, and wherein said cylindrical carrier ring has an external diameter which is greater than that of the contact sleeve.

* * * * *